United States Patent [19]

Jacobsen

[11] 4,307,477

[45] Dec. 29, 1981

[54] BEDDING ARRANGEMENTS

[75] Inventor: Erling Jacobsen, Haugesund, Norway

[73] Assignee: A/S Norsy Stalromobelfabrikk, Haugesund, Norway

[21] Appl. No.: 97,806

[22] Filed: Nov. 27, 1979

[51] Int. Cl.[3] ..... A61G 7/02; A61G 7/06

[52] U.S. Cl. ..... 5/68; 5/90

[58] Field of Search ..... 5/90, 81 R, 66, 67, 5/68; 297/284

[56] References Cited

U.S. PATENT DOCUMENTS

| | | | |
|---|---|---|---|
| 566,114 | 8/1896 | Young | 5/66 |
| 1,086,584 | 2/1914 | Bown | 5/90 |
| 1,132,614 | 3/1915 | Payne | 5/66 |
| 3,224,016 | 12/1965 | Anderson et al. | 5/81 R |

*Primary Examiner*—Roy D. Frazier
*Assistant Examiner*—Alexander Grosz
*Attorney, Agent, or Firm*—Kenyon & Kenyon

[57] ABSTRACT

Bedding arrangement having a base for disposing on the surface of a bed and an adjustable back support with a frame pivotably mounted at the surface of the base enabling adjustment of the back support into various angular positions relative to the surface of the base. A board for supporting the back of a bed-ridden patient is pivotably mounted on the frame adjacent a head-resting portion of the latter. The board is upwardly pivotable in a direction opposite an upward pivotable movement of the frame whereby the patient assumes a recumbent position raised above the surface of the bed permitting unhindered introduction of a bed pot under the patient.

8 Claims, 2 Drawing Figures

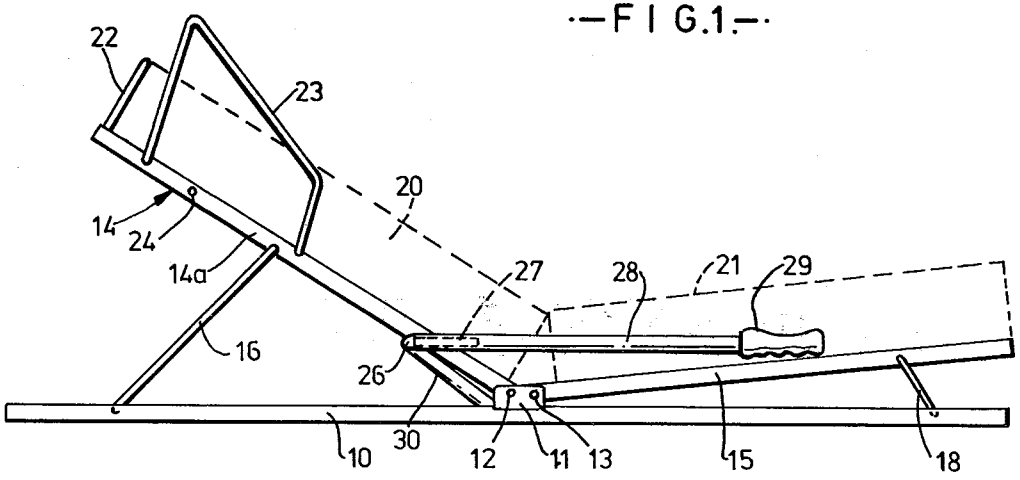
—FIG.1.—
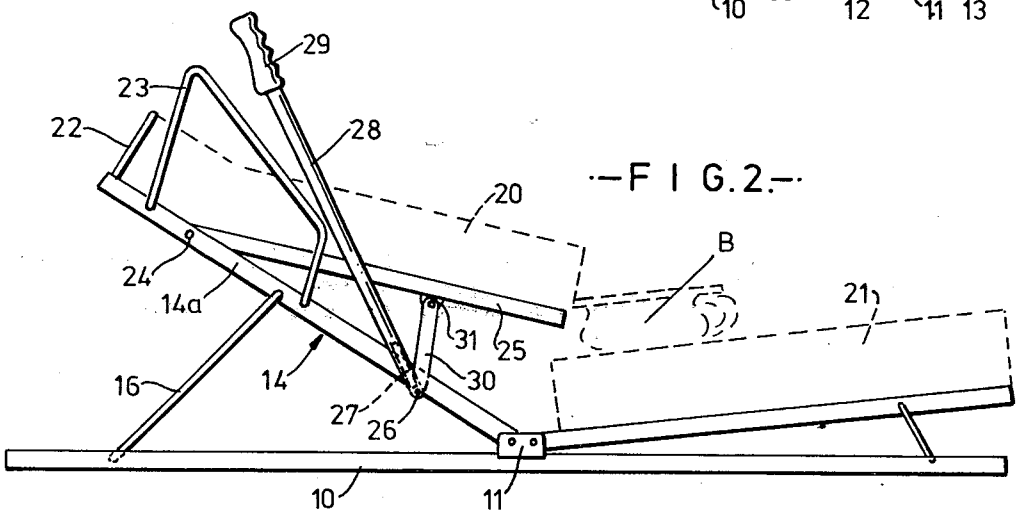
—FIG.2.—

BEDDING ARRANGEMENTS

This invention relates to bedding arrangements.

An aim of the present invention is to provide bedding arrangements which are particularly designed for the handling and nursing of bed-ridden persons and especially patients who require assistance in connection with bowel movements, washing and the like. In particular, there is a need to be able to place human waste-receiving means, e.g. a bed pot or a bed pan, under or remove a used receptacle from beneath the bed-ridden person in a ready and simple manner.

A lifting mechanism is known from U.S. Pat. No. 3,312,985 for elevating the upper body and seat portion of a patient vertically upwards by means of a vertical back support member. Here, one is dependent upon a pneumatically, electrically or hydraulically driven lifting mechanism, something which severely complicates the design of the bed or bedding and which makes cleaning (disinfecting) difficult.

It is an object of the present invention to provide a bed or bedding which is light to carry and easy to handle preferably manually and where one can, if desired, be independent of electrical, hydraulic or pneumatic components.

An ambulance bed is known from Swedish Patent Specification No. 132,492 where the bedding can be rearranged in various folded positions with the aid of mechanical means. There are employed a series of hand crank-operated regulating rods and associated pivot arms, and the result is a relatively complicated mechanical solution which is particularly suited for use in hospitals and like institutions. Also, this construction is difficult to keep clean (disinfect).

A simpler solution is an aim of the present invention which can be used equally well in the home as in hospitals and other institutions. Particular emphasis is placed on the arrangement being easy to handle and light to carry, and easy to clean (disinfect) and maintain.

According to the present invention, a bedding arrangement comprises a base frame for disposing on the surface of a bed and an adjustable back support component comprising a frame portion pivotably mounted at one end about a horizontal axis at the surface of the base frame enabling adjustment of the back support component into various angular positions relative to base frame and a board for supporting the back of a bed-ridden patient mounted on the frame portion to pivot about a horizontal axis adjacent a head-resting portion of the frame portion. The board is upwardly pivotable in a direction opposite an upward pivotable movement of the frame portion whereby the patient assumes a recumbent position raised above the surface of the bed enabling the unhindered introduction of human waste-receiving means under the patient.

By means of a simple handle, the bedding can be rearranged in various positions of use, and the bed-ridden person can be arranged readily in a desired position on, for example, a bed pan or in such a position that the person can be washed and cared for in a convenient manner in order to bring that person, thereafter, back to the starting position on the bedding.

It will naturally be possible to rearrange the back support means and the back-supporting board separately by means of a small electromotor, gas spring or a similar power-driven lifting arrangement. Such a simple power-driven lifting arrangement does not need to complicate the arrangement to a significant degree, as the back support means with associated back-supporting board is of an especially simple construction. However, in practice, it is preferred that in the upswung position, the back-supporting board is supported by support arm means extending substantially at right angles to the board. The support arm means is pivotably mounted on the frame and is turnably connected to a lifting arm for swinging the support arm means to and from the support position and simultaneously swinging (lifting and lowering) the back-supporting board relative to the frame. There is thus obtained a particularly simple, manually handleable construction where one is independent of extra power-driven lifting devices.

In order to achieve a ready rearrangement of the back-supporting board from the starting position to a lifted position and back again, it is preferred that the outer end of the support arm means forms a supporting abutment against the board via a support roller.

In order that the invention can be more clearly understood, a convenient embodiment thereof will now be described, by way of example, with reference to the accompanying drawings in which:

FIG. 1 is a side view of a bedding arrangement shown in a starting position, and FIG. 2 is a side view similar to that of FIG. 1 except that the bedding arrangement is in a particular position of use.

The bedding arrangement illustrated in the drawings is designed for resting in a position against the top of a conventional bed and is particularly designed for use in the home. By disposing the arrangement on the top of a conventional bed the bed-ridden person can be supported at a level above the normal bedding level so that that person is thereby easier to handle and take care of in convenient working positions.

Alternatively, the arrangement can be provided with separate, foldable support legs so that, when desired, the arrangement can be employed as a separate, detached bedding independent of a usual bed, for example, for use in a hospital, old age home or similar institution.

Referring to the drawings, the bedding arrangement comprises a rigid, lower base frame 10, which can either rest directly against the top of a conventional bed or which can support support legs which can be folded up and down while pivotably mounted directly on the base frame 10.

In upwardly projecting brackets 11, which are fastened approximately at the center of the length of the base frame 10, there are pivotably mounted about their respective transverse horizontal pivotal axes, as illustrated by pivot pins 12 and 13, a back support component 14 and a leg support component 15. By means of a support loop 16 which is pivotably mounted about a horizontal axis on a frame portion 14*a* of the back support component 14 just by a head resting portion of the back support component, the back support component 14 can be adjusted into various inclined positions relative to the base frame 10, due to its opposite end being received in stop grooves (not shown) in the base frame 10. The leg support component 15 can be adjusted into similar inclined positions relative to the base frame 10 by means of a support loop 18 which is pivotably mounted on a frame portion of the leg support component 15 and is adapted to be received in various stop grooves (not shown) in the base frame 10. In the drawings, there is shown, in broken lines, a two part mattress 20, 21, that is to say a first mattress portion 20 which rests against the back support component 14 and a second mattress portion 21 which rests against the leg support component 15. The mattress portion 20 is held in position, endways and sideways, on the back support component 14 by means of a head rest loop 22 and side loops 23 which are fastened to the frame portion 14*a* of the back support component 14.

On the frame portion 14*a* of the back support component 14, there is pivotably mounted, just by the head rest loop 22, about a transverse horizontal axis as illustrated by the pivot pin 24, a back-supporting board 25 which forms the main support surface for the mattress portion 20. The leg support component 15 comprises an outer frame portion and an associated board or similar mattress-supporting part which is fixedly connected to the outer frame portion. On the under side of the frame portion 14*a* of the back support component 14, a short lifting arm 27 (shown in broken lines) is fastened to a transverse shaft pin 26. On the lifting arm 27, there is threaded on endways a removeable pipe-shaped extension arm 28 having a grip handle 29. Furthermore, the shaft pin 26 is rigidly connected to a support arm means in the form of a pair of parallel lifting arms 30 (only one is shown in the drawings) which between them, at the free outer end, support a roller 31 composed of a synthetic plastics material, which is adapted to roll along the under side of the back-supporting board. On swinging the lifting arm 27 with the extension arm 28 from the position shown in FIG. 1 to the position shown in FIG 2, the lifting arms 30 and the associated roller 31 are swung correspondingly so that the free outer end of the back-supporting board 25 is raised upwardly to a level above the adjacent end of the mattress portion 21 on the leg support component 15. In FIG. 2, the lifting arms 30 are shown in an outer position in which they are swung about a dead center to a self-locking support position for the back supporting board 25, that is to say swung to an angular position of about 88° relative to the back-supporting board 25.

In FIG. 1, the arrangement is shown in a normal support position for a bed-ridden patient, that is to say with an inclined upwardly extending back support component 14 and leg support component 15 so that the patient assumes a slightly V-shaped position. When a bed pot B is to be introduced under the patient, the seat portion of the patient can be raised vertically upwards by means of the swingable back-supporting board 25 to the position which is shown in FIG. 2. In this way, the pot B can be introduced in a ready manner beneath the upwardly raised seat portion of the patient. Thereafter, on lowering the back-supporting board 25 back to the starting position as shown in FIG. 1, the patient can be placed directly in place in a sitting position on the pot. If desired, the patient can, thereafter, be adjusted into further erect sitting positions on the pot, for example, by the further swinging of the back support component 14 in a clockwise direction in the drawings. When the pot is to be removed after use, a corresponding reverse swinging of the patient can be effected to the starting position of FIG. 1 via the position shown in FIG. 2.

In the drawings, there is shown a preferred manual lifting mechanism for rearranging the patient in various positions. However, it is apparent that, alternatively or in addition, there can be employed pneumatically, hydraulically or electrically driven lifting devices or a so-called gas spring for lifting and lowering the back-supporting board 25.

I claim:

1. A bedding arrangement comprising a base frame; and a back support component including a frame portion pivotally mounted on said base frame and having a head resting portion and a back-supporting board pivotally mounted on said frame portion on a horizontal axis adjacent said head resting portion, said board being upwardly pivotable in a direction opposite an upward pivotable movement of said frame portion for positioning a patient in a recumbent raised position enabling the introduction of waste-receiving means under the patient.

2. A bedding arrangement as set forth in claim 1 which further comprises a support arm means pivotally mounted on said frame portion for abutting said board and a lifting arm secured to said support arm means for pivoting said support arm means to pivot said board relative to said frame portion.

3. A bedding arrangement as set forth in claim 2 wherein said support arm means is pivotable into a position at a right angle to said board.

4. A bedding arrangement as set forth in claim 3 wherein said support arm means includes a roller for rolling on said board to support said board in said position.

5. A bedding arrangement as set forth in claim 2 wherein said support arm means includes a pair of parallel lifting arms and a roller supported between said arms for rolling along the underside of said board.

6. A bedding arrangement as set forth in claim 2 which further comprises an extension arm removeably secured to said lifting arm.

7. A bedding arrangement as set forth in claim 1 which further comprises a support loop pivotally mounted on said frame portion for reception in a selected stop groove in said base frame for adjusting said frame portion relative to said base frame.

8. A bedding arrangement as set forth in claim 1 which further comprises a leg support component pivotally mounted on said base frame adjacent said frame portion.

* * * * *